United States Patent [19]

Tomashauser et al.

[11] Patent Number: 4,737,209

[45] Date of Patent: Apr. 12, 1988

[54] METHOD OF AND DEVICE FOR APPLYING FOIL TO A CONTAINER AND ESPECIALLY TO A BOTTLE

[76] Inventors: Josef Tomashauser, Kehnerstr. 6, 4151 Willich 2; Rudolf Zodrow, Lichtstr. 37, 4000 Dusseldorf; Rudolf Gruber, Am Jagerhof 19, 4048 Grevenbroich 5, all of Fed. Rep. of Germany

[21] Appl. No.: 916,582

[22] Filed: Oct. 8, 1986

[30] Foreign Application Priority Data

Dec. 13, 1985 [DE] Fed. Rep. of Germany ..... 3544069

[51] Int. Cl.[4] ..... B65C 3/18; B65C 3/22; B65C 9/36

[52] U.S. Cl. ..... 156/69; 156/213; 156/215; 156/477.1; 156/488; 156/581; 156/DIG. 14; 156/DIG. 16; 156/DIG. 42; 53/296; 53/357; 53/580

[58] Field of Search ..... 156/DIG. 12, DIG. 14, 156/DIG. 15, DIG. 16, DIG. 17, 477.1, 539, 69, 580, DIG. 42, 581, 213, 478, 480, 481, 482, 488, 215, 226; 53/397, 131, 132, 290, 296, 359, 357, 358, 360, 361, 362, 344, 345, 346, 580, 49

[56] References Cited

U.S. PATENT DOCUMENTS 4,414,056 11/1983 Buchholz ..... 156/486

4,613,397 9/1986 Buchholz ..... 156/DIG. 16

*Primary Examiner*—Donald E. Czaja
*Assistant Examiner*—J. Davis
*Attorney, Agent, or Firm*—Sprung Horn Kramer & Woods

[57] ABSTRACT

A method of and device for applying foil to a container that has a closure over its upper surface, and especially to a bottle with a head that along with its cap is to be wrapped all the way around with a blank, especially of foil, by applying the blank around the head while leaving part of the blank to project beyond it, wrapping the sleeve-shaped extension to one side against the upper surface of the cap to create an outer cap cover, and pressing it down, especially with a resilient pad. To improve the method and device of the aforesaid type to the extent that it becomes possible to press the sleeve-shaped foil extension down over the upper surface of the cap optimally single-layered and wrinkle-free and hence to employ pre-printed foil, a flute that initially extends essentially parallel to the axis of the bottle is shaped into the sleeve-shaped extension while the latter is being wrapped and is tapered out from the lip of the bottle to the peak of the extension with the folded areas of the two sides of the section that has been shaped into the flute coming to rest essentially outside the upper surface of the cap.

11 Claims, 5 Drawing Sheets

METHOD OF AND DEVICE FOR APPLYING FOIL TO A CONTAINER AND ESPECIALLY TO A BOTTLE

BACKGROUND OF THE INVENTION

The present invention relates to a method of applying foil to a container that has a closure over its upper surface, and especially to a bottle with a head that along with its cap is to be wrapped all the way around with a blank, especially of foil, by applying the blank around the head while leaving part of the blank to project beyond it, wrapping a sleeve-shaped extension to one side against the upper surface of the cap to create an outer cap cover, and pressing it down, especially with a resilient pad.

Containers for foods and beverages, especially bottles, are frequently not only labeled but also wrapped around the head with a blank of metal foil to make them more attractive. What is especially difficult in this process is to smooth the foil over the upper surface of the cap. The smoother and flatter the foil over the upper surface, the more attractive the bottle.

Successful results have been obtained with a method and device for applying foil in which the sleeve-shaped extension is not immediately twisted into a point and the pressed flat once the head of the bottle has been wrapped, but in which the apexes of the triangle are wrapped over the upper surface without being twisted and then pressed down by a resilient pad. There is, however, a drawback to the method. It has not as yet resulted in unwrinkled single-layer coverage of the upper surface by the foil.

Furthermore, it would often be desirable to be able to print reading matter or graphics on the foil covering the upper surface of the cap, a process that has been impossible to do successfully up to now because the wrinkles in the foil would cause gaps in the printed matter. This problem has resulted in the foil being left unprinted.

Methods of printing the unwrapped upper surface of crown-corked bottles are of course known. Enclosing the head and cork of a crown-corked bottle in a capsule of plastic or lead already embossed with printed matter is also known. Finally, bottles closed with stoppers that have heads embossed with printed matter are also known.

SUMMARY OF THE INVENTION

The object of the present invention is to improve the method and device of the aforesaid type to the extent that it becomes possible to press the sleeve-shaped foil extension down over the upper surface of the cap optimally single-layered and wrinkle-free and hence to employ pre-printed foil.

This object is attained in the method in accordance with the invention by an improvement wherein a flute that initially extends essentially parallel to the axis of the bottle is shaped into the sleeve-shaped extension while the latter is being wrapped and is tapered out from the lip of the bottle to the peak of the extension with the folded areas of the two sides of the section that has been shaped into the flute coming to rest essentially outside the upper surface of the cap.

The invention accordingly prevents the random wrinkling of the sleeve-shaped extension that is impossible to remove from the vicinity of the upper surface of the cap. Since shaping the flute in accordance with the invention restricts the extent of the double layer on each side, there will be only a single layer of foil in the vicinity of the upper surface of the cap when the flute is finally tapered out. The subsequent pressure applied by the resilient pad in a known way will therefore entail no further problems. The special method of shaping the flute in accordance with the invention and its gradual outward tapering also ensure that the sleeve-shaped extension can be wrapped at the rate of several tens of thousands of bottles an hour that prevails in contemporary labeling machines.

Since the blank comes to rest against the upper surface in a single layer and without wrinkles in the method in accordance with the invention, the method is especially practical for applications in which the upper surface of the cap is wrapped with foil that contains printed matter. In this case a blank of foil with printed matter located where it will be properly positioned over the upper surface of the cap can be employed.

At high labeling rates the flute should be shaped within a small area half-way up or at the top of the extension.

The invention also relates to a device for carrying out the method and comprising a foil-application station that is positioned alongside the path traveled by the bottles and transfers blanks of foil to them, components that are positioned alongside the path and apply the transferred blanks, at least one wrapping component that can be positioned over the head of the bottle and acts on the sleeve-shaped extension, and at least one component that can be employed at the upper surface of the cap to apply pressure to the blank.

The object is attained in the device in accordance with the invention by an improvement wherein the wrapping component is shaped like a triangular saddle with one apex pointing, along with the adjacent, symmetrically positioned rear, toward the downstream end of the sleeve-shaped extension.

One embodiment of the wrapping component in accordance with the invention can be pivoted at the end of a carrier out of an upright position into a horizontal position around a pivot that extends perpendicular to the axis of symmetry of the rear of the saddle shape and to the axis of the article being wrapped. The component can be pivoted in such a way that the saddle shape will contact the upper edge of the article during the relative motion between the wrapping component and the article.

Another embodiment of the wrapping component in accordance with the invention is coupled to a mechanism that produces the pivoting motion.

The relative motion that is necessary between the sleeve-shaped extension of the blank of foil and the wrapping component in order to wrap the extension can be produced in different ways and by different means. Thus, the wrapping component can be positioned stationary above the path that the articles travel along. It is, however, also conceivable for the wrapping component to be capable of being moved along with its carrier across the axis of and above the article. The latter embodiment is itself susceptible to different variations. Thus, either the carrier can be pivoted or the carrier can be mounted in such a way as to rotate around an axis that extends perpendicular to the axis of the article being wrapped.

The first system is, as far as the special design of the wrapping component, known. Thus, a pivoting unit that consists of a wrapping component and of a resilient pad that can be lowered onto the upper surface of the bottle cap is associated with each bottle accommodation in the outtake wheel of a labeling machine that is known from German Application No. 3 046 615 C3. Another wheel with a shorter diameter and with the same number of accommodations and conveyor speed is positioned eccentric to the outtake wheel with the accommodations in another labeling machine, known from German Application No. 3 345 226 C3, in such a way that the peripheral paths of the wheels are tangent. The second and smaller wheel has a wrapping component with a resilient pad that can be lowered onto the upper surface of the bottle cap at each accommodation. The projecting peak of the blank of foil is wrapped where the paths of the outtake wheel and of the smaller wheel with the wrapping components gradually merge, with the resilient pad descending as the articles continue to travel and pressing the blank down.

Some preferred embodiments of the invention will now be described with reference to the attached drawings, wherein

DETAILED DESCRIPTION OF THE PREFERRED EMBODIMENTS

Figure 1:
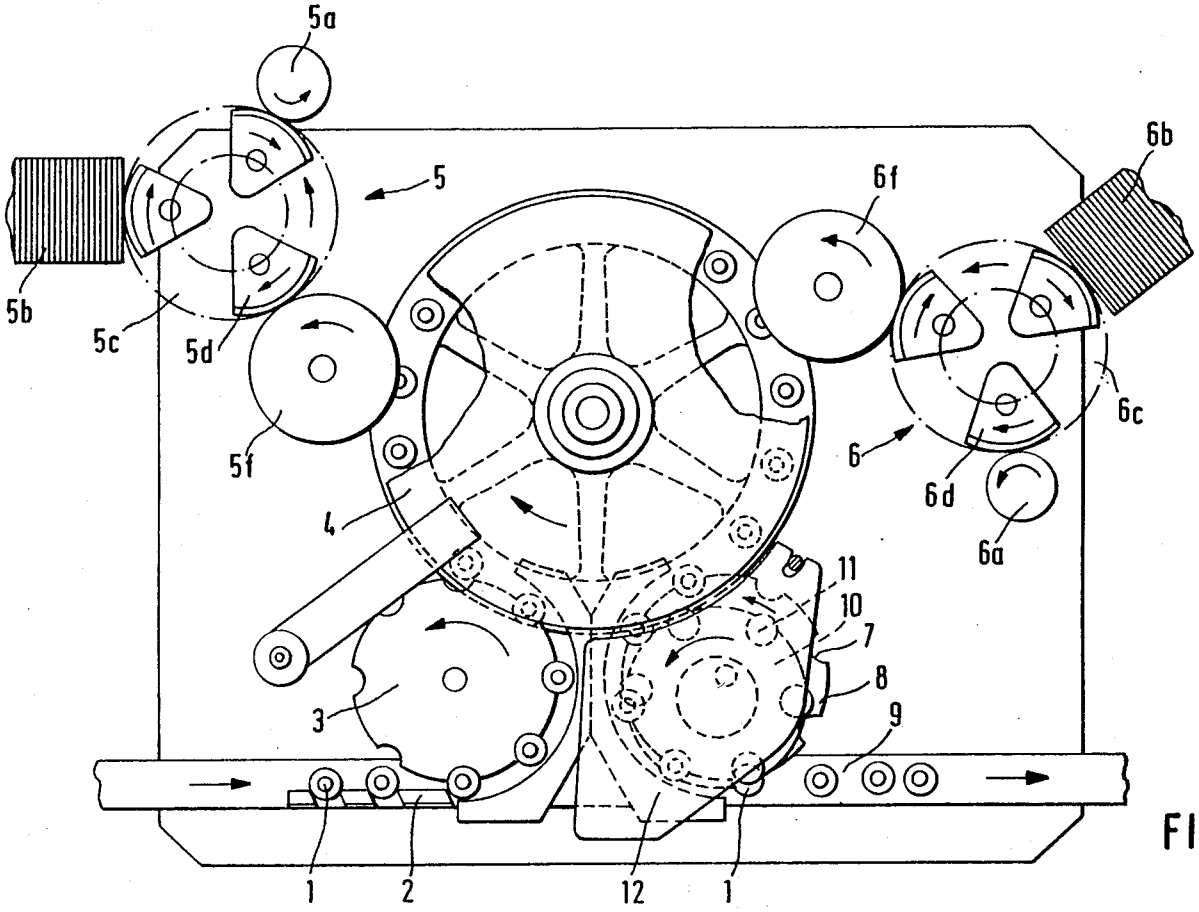
FIG. 1 is a schematic view of a labeling machine from the top.

Bottles 1 that are to be labeled and have foil applied to them arrive in the accommodations in a turntable 4 from an intake worm 2 and an intake wheel 3. The bottles are axially secured in a known way in the accommodations between an unillustrated computer-controlled rotating plate and unillustrated bells. As the bottles travel along in turntable 4 they arrive first in front of a belly labeling station 5 and then in front of a foil-application station 6. Each station 5 and 6 has an adhesive-application roller **5*a* or 6*a*, a stationary magazine 5*b* or 6*b* for labels or blanks of foil respectively, a rotating carrier 5*c* or 6*c* with label or blank transfers 5*d* or 6*d* respectively, and a gripper cylinder 5*f* or 6*f* for applying the labels or blanks respectively to the bottles. Foil-application station 6** is equipped for applying blanks of foil with their peak pointing up and with printed matter in the vicinity of the peak.

The total surface of the labels or blanks applied to bottles 1 by gripper cylinders **5*f* or 6*f* respectively is, as the bottles continue to travel, smoothed down downstream of stations 5 and 6 by unillustrated stroking components (brushes), with each bottle rotating around its own axis. A triangular sleeve-shaped extension is left projecting above the head of the bottle. The bottles, accordingly provided with labels and foil, are then transferred with the sleeve-shaped extension downstream to accommodations 7 in an outtake wheel 8, in which they are secured in the angular position that they arrive in by clamps for example. As the bottles continue to travel, the sleeve-shaped extension is wrapped around and pressed down wrinkle-free against the upper surface of the bottle cap. Next, the bottles arrive on a conveyor belt 9 that removes the bottles. Above and eccentrically positioned in relation to outtake wheel 8 is a circular plate 10 that carries the components, specified in what follows, for wrapping and pressing down the sleeve-shaped extension of the blank of foil. The distance between (circumferential distribution of) the sites 11 on carrier plate 10, which are illustrated only schematically in FIG. 1, corresponds to that between the accommodations 7 in outtake wheel 8. At a certain point 12, as will be evident from FIG. 1, the path of accommodations 7 is tangent to or slightly intersects that of the sites 11 of the wrapping and pressure-application components. Given the difference between the diameters of outtake wheel 8 and carrier plate 10, the orbits of accommodations 7 and sites 11, and the eccentric position of plate 10, outtake wheel 8 and carrier plate 10 are powered to rotate at essentially the same speed at point 12. As will also be evident from FIG. 1, each site 11 travels over an accommodation 7 as the site enters the latter's path and coincides with it at point 12**.

Figure 2:
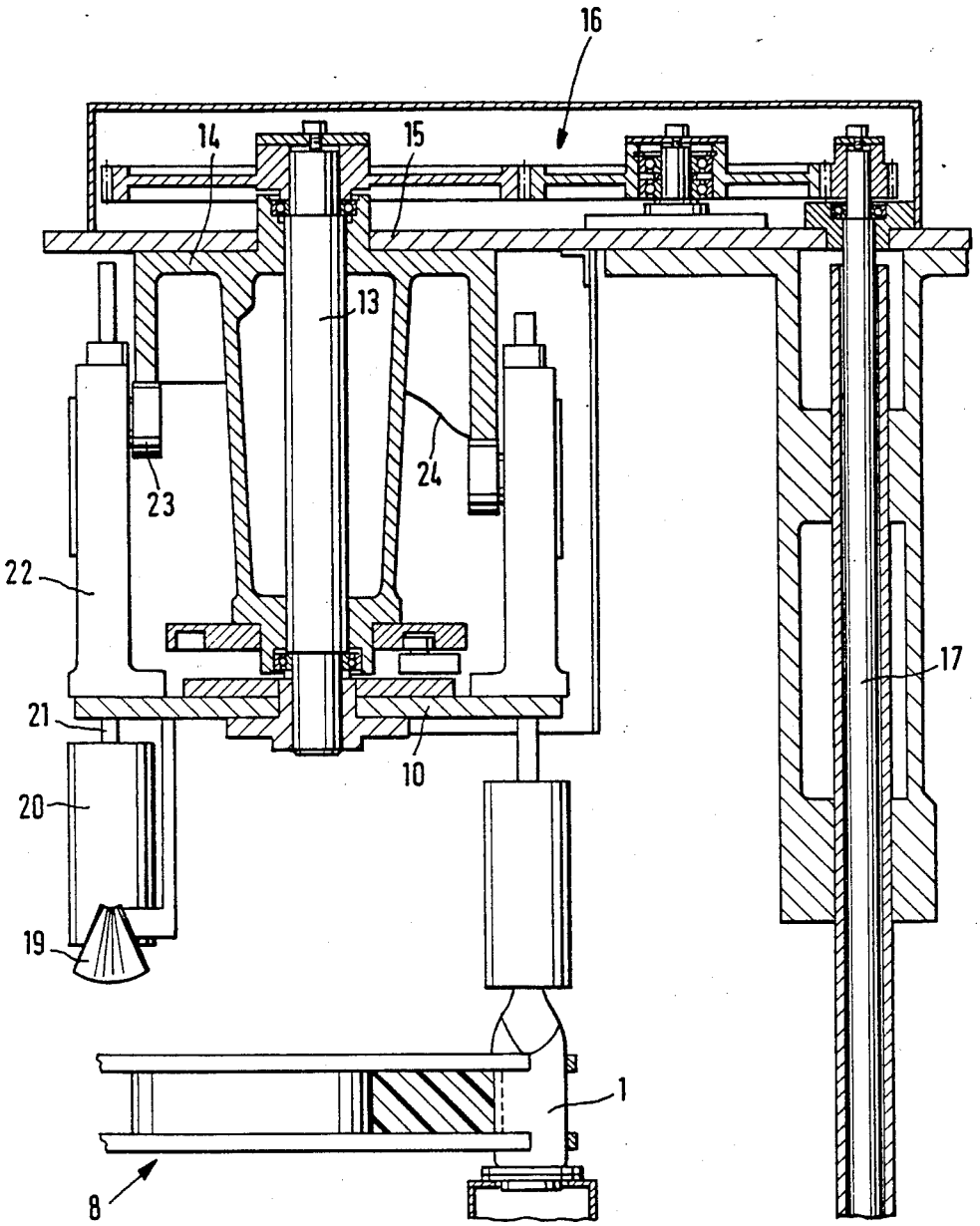
FIG. 2 is a section through the outtake wheel of the labeling machine along the line I—I in FIG. 1.

FIG. 2 illustrates the design of the circular carrier plate 10 above outtake wheel 8. Carrier plate 10 is mounted on a shaft 13 and secured in a bearing box 14 fastened to a base plate 15. Shaft 13 is driven through a gear bridge 16 by another shaft 17 deriving from the main drive mechanism. Mounted on a lever-like carrier 18 (FIG. 3) at each site 11 along the circumference of carrier plate 10 are a wrapping component 19 that can be pivoted around a horizontal axis and a pressure-application component 20 that can be raised and lowered. Wrapping component 19 and pressure-application component 20 are spatially associated in such a way that component 19 arrives in the vicinity of the head of each bottle upstream of component 20. Each pressure-application component 20 is raised and lowered in a housing 22 by means of a positioning rod 21. Positioning rod 21 is engaged by an unillustrated compression spring that forces pressure-application component 20 into its upper position, illustrated at the left in FIG. 2. Positioning rod 21 is also engaged by a follower 23 that operates in conjunction with a stationary cylindrical cam 24 on bearing box 14. Thus, each pressure-application component 20 is raised and lowered in conformity with cylindrical cam 24 as carrier plate 10 rotates.

The design of a plate 10 for carrying pressure-application components and its position relative to an outtake wheel is in itself known from the aforesaid German Application No. 3 345 226 C3. What is novel in relation to that state of the art in this context is the design of the wrapping component 19, which will be specified later herein.

Instead of a carrier plate 10 for wrapping components 19 and pressure-application components 20 and positioned eccentric to outtake wheel 8, a pivoting unit consisting of a pressure-application component that can be raised and lowered and of an upstream wrapping component in the shape of a roller can be associated with each accommodation 7 in outtake wheel 8. In this case, once the unit has been pivoted over the head of the bottle, it is lowered, and the sleeve-shaped extension is pressed down with the pressure-application component. This method of wrapping and pressing down the extension is also in itself known from the other aforesaid German Application No. 3 046 615 C3.

Figure 3:
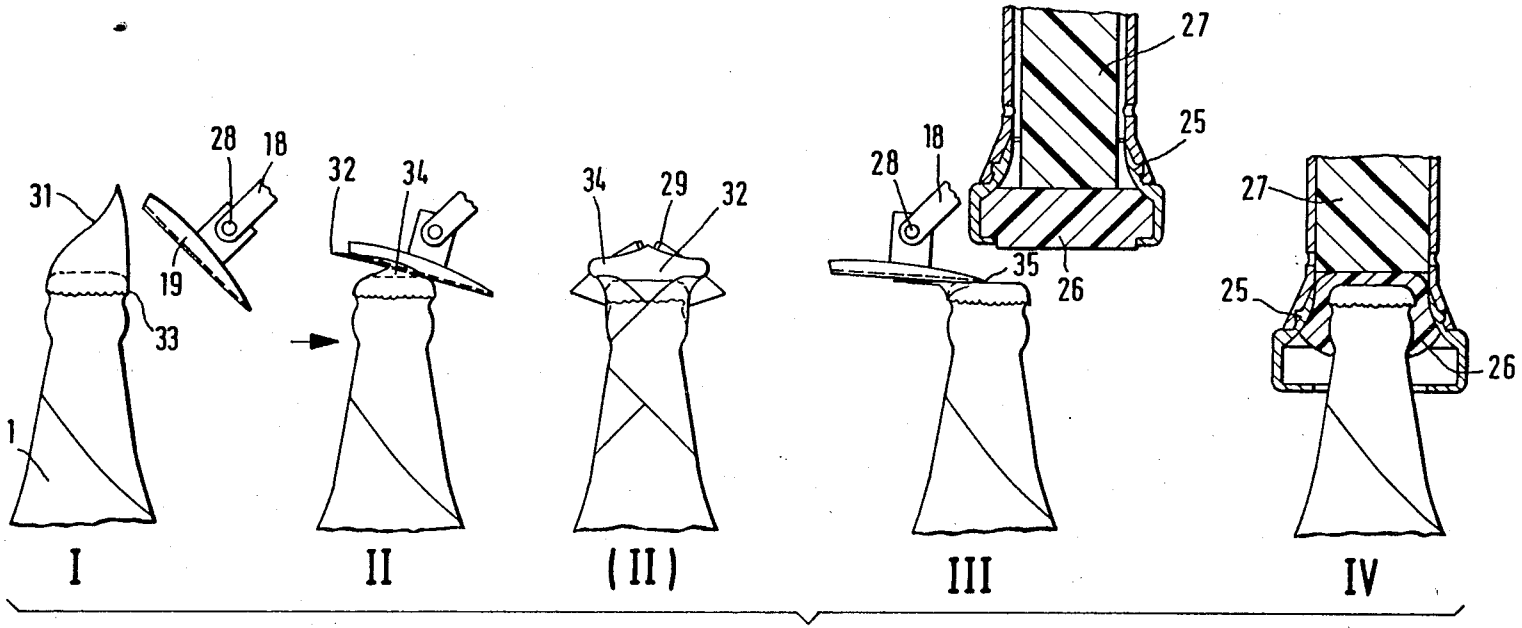
FIG. 3 illustrates a bottle with associated wrapping and pressure-application components at different stages of the wrapping operation.
Figure 4:
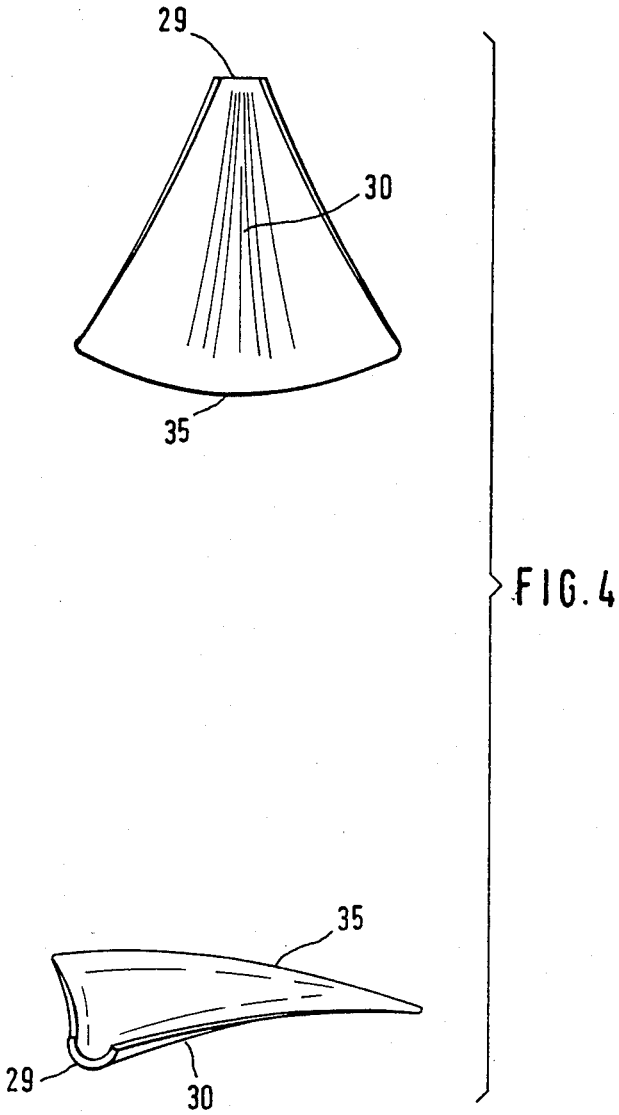
FIG. 4 illustrates the saddle-shaped wrapping component, from above at the top and in perspective at the bottom.

The design of wrapping component 19 and of pressure-application component 20 will be most evident from FIG. 3, step III in conjunction with FIG. 4. Pressure-application component 20 consists of a pad 26 positioned in a flowerpot-shaped housing 25 that can be raised and lowered. The back of pad 26 rests against a resilient structure 27. Due to the specific conformation of flowerpot-shaped housing 25, pad 26, and resilient structure 27, the face of pad 26 will roll over and around the head of the bottle, smoothing and pressing down the foil as illustrated in step IV. The specific design of pressure-application component 20 is known.

Wrapping component 19 is positioned upstream of pressure-application component 20 and is mounted in such a way as to rotate around a pivot 28 on carrier 18 against the force of an unillustrated spring. Pivot 28 is perpendicular to the axis of the bottle. Wrapping component 19 is, as will be evident from FIG. 4, in the shape of a triangular saddle with one apex 29 facing the downstream side of the sleeve-shaped extension 31 of the blank of foil and with a symmetrically positioned rear 30.

The various stages of wrapping and pressing down sleeve-shaped extension 31 are illustrated in FIG. 3.

In stage I the curved apex 29 of wrapping component 19 comes into contact with the sleeve-shaped extension 31 on the blank, initiating the process of shaping a flute 32 in the extension. A flute of this type can also be produced with an upright wrapping component 19. Component begins to pivot as soon as the relative motion between it and bottle 1 brings the component into contact with the downstream edge 33 of the head of the bottle.

In step II wrapping component 19 has attained its maximum pivoting motion, and the sides 34 of the wrapped portion of the blank still project.

In stage III, on the other hand, wrapping component 19 has, due to its greater width with respect to edge 35, spread sides 34 out and brought them into the same plane as the rest of the blank.

In the final stage, stage IV, resilient pad 26 is above the upper surface of the bottle cap and is being forced axially against it. The foil is being pressed down not only at the upper surface but also around the upper edge of the head of the bottle.

Since foil-application station 6 can position the blank precisely on bottle 1 and since the blank can accordingly not be displaced in relation to the bottle, a prescribed position for applying printed matter to the blank ahead of time can be determined, and the printed matter will finally be located where desired. The method of wrapping in accordance with the invention ensures that the blank will lie against the upper surface of the cap unwrinkled, a prerequisite for perfect printing.

Figure 5:
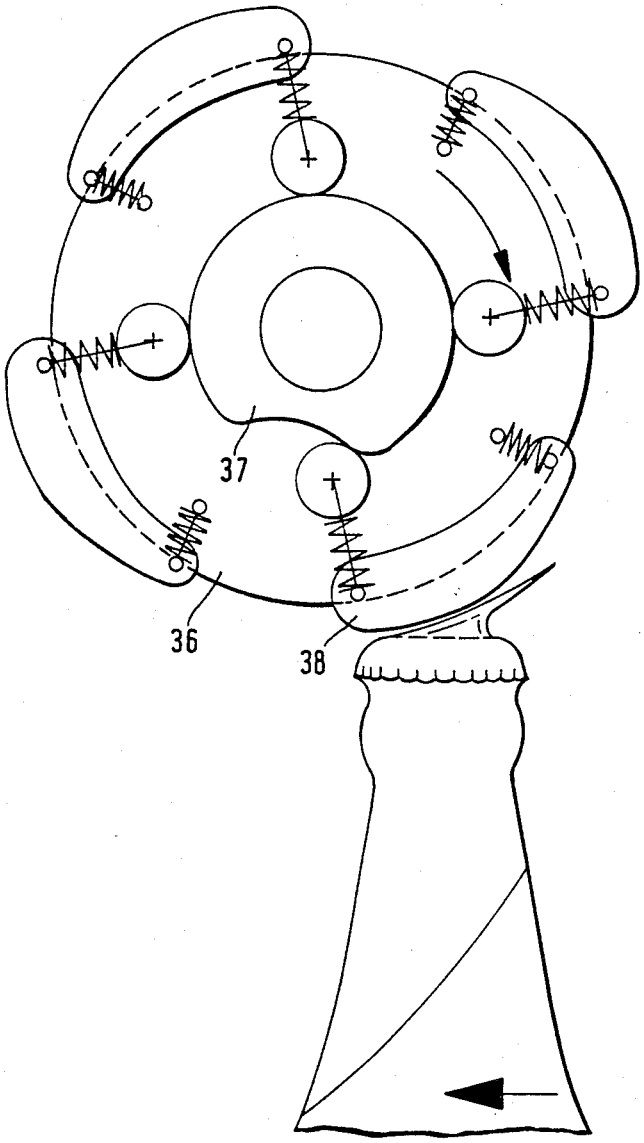
FIG. 5 is a schematic side view of several wrapping components mounted on a carrier in the form of a wheel.

Instead of a separate wrapping component associated with each pressure-application component as specified in the foregoing, it is also possible to employ a common wrapping mechanism with several saddle-shaped components of the type illustrated in FIG. 4 in conjunction with pressure-application components of the specified type. A wrapping mechanism of this type can be positioned in a section of the path traveled by the bottles that is just downstream of turntable 4 and that is not covered by a round carrier plate 10. FIG. 5 illustrates a wrapping mechanism of this type. It consists of a rotating carrier 36 in the shape of a wheel with several saddle-shaped wrapping components 38 distributed around its circumference and guided radially by a cam 37.

It will be appreciated that the instant specification and claims are set forth by way of illustration and not limitation, and that various modifications and changes may be made without departing from the spirit and scope of the present invention.

What is claimed is:

1. In a method of applying foil to a bottle with a head that along with its cap is to be wrapped all the way around with a blank of foil, by applying the blank around the head while leaving part of the blank to project beyond the head, wrapping a sleeve-shaped extension of the blank to one side against an upper surface of the cap to form an outer cap cover, and pressing the sleeve-shaped extension down, a resilient pad, the improvement comprising shaping the sleeve-shaped extension while it is being wrapped to form a flute that initially extends essentially parallel to the axis of the bottle, expanding and flattening the flute until it contacts the cap and flattening the foil to form two folded areas that extend from two sides of the flute and terminate essentially outside the upper surface of the cap.

2. The method as in claim 1, wherein the blank of foil has printed matter located where it will be positioned over the upper surface of the cap.

3. The method as in claim 1, wherein the flute is shaped within a small area half-way up the extension.

4. The method as in claim 1, wherein the flute is shaped at the top of the extension.

5. In a device for applying foil to a bottle with a head and cap to be wrapped, having means for transporting bottles in a path, a foil-application station positioned alongside the path traveled by the bottles for transferring blanks of foil to the bottles to form a sleeve-shaped extension, at least one wrapping component positioned over the head of each bottle for acting on the sleeve-shaped extension, and at least one component disposed at an upper surface of the cap to apply pressure to the blank, the improvement wherein the at least one wrapping component comprises a triangular saddle shaped element with one apex pointing, along with an adjacent, symmetrically poitioned rear portion toward a downstream end of the sleeve-shaped extension for shaping a flute into the extension, the flute extending essentially parallel to the axis of the bottle.

6. The device as in claim 5, further comprising means mounting the at least one wrapping component for pivotal movement out of an upright position into a horizontal position around a pivot axis that extends perpendicular to the axis of symmetry of the rear portion of the saddle and to the axis of the bottle being wrapped.

7. The device as in claim 5, wherein the means mounting the at least one wrapping component is coupled to a mechanism that produces a pivoting motion.

8. The device as in claim 5, wherein the at least one wrapping component is positioned stationary above the path that the bottles travel along.

9. The device as in claim 5, wherein the means mounting the at least one wrapping component includes a carrier which is movable with the at least one wrapping component across the axis of and above each bottle.

10. The device as in claim 9, wherein the carrier is pivoted.

11. The device as in claim 9, wherein the carrier is mounted to rotate around an axis that extends perpendicular to the axis of each bottle.

* * * * *